US011131154B2

(12) United States Patent
Lewis et al.

(10) Patent No.: US 11,131,154 B2
(45) Date of Patent: Sep. 28, 2021

(54) FORMATION SCREW AND CENTRALIZER

(71) Applicant: Halliburton Energy Services, Inc., Houston, TX (US)

(72) Inventors: Samuel J. Lewis, Spring, TX (US); Michael T. Pelletier, Houston, TX (US); William Cecil Pearl, Jr., Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 251 days.

(21) Appl. No.: 16/542,021

(22) Filed: Aug. 15, 2019

(65) Prior Publication Data

US 2021/0047890 A1 Feb. 18, 2021

(51) Int. Cl.
*E21B 17/10* (2006.01)
*E21B 33/14* (2006.01)

(52) U.S. Cl.
CPC ..... *E21B 17/1078* (2013.01); *E21B 33/14* (2013.01)

(58) Field of Classification Search
CPC ..... E21B 17/10
See application file for complete search history.

(56) References Cited

U.S. PATENT DOCUMENTS

| | | | |
|---|---|---|---|
| 4,681,161 | A | 7/1987 | Arterbury et al. |
| 5,355,950 | A | 10/1994 | Zwart |
| 7,281,839 | B1 | 10/2007 | Zimmerman |
| 2004/0182571 | A1 | 9/2004 | Betts |

(Continued)

FOREIGN PATENT DOCUMENTS

| | | | |
|---|---|---|---|
| GB | 833695 | A | 4/1960 |
| WO | 8702409 | A1 | 4/1987 |
| WO | 2015013438 | A1 | 1/2015 |

OTHER PUBLICATIONS

"Rotating works by John Edmark—JohnEdmark.com"; http://www.johnedmark.com/work/rotating/; Aug. 21, 2018; 1 page.

(Continued)

*Primary Examiner* — William D Hutton, Jr.
*Assistant Examiner* — Avi T Skaist
(74) *Attorney, Agent, or Firm* — John W. Wustenberg; Parker Justiss, P.C.

(57) ABSTRACT

A centralizer apparatus for deployment in a subterranean wellbore, including a tubular adapted to be deployed in the subterranean wellbore such that a long axis of the tubular is parallel to a portion wellbore and a stack of fin modules stacked parallel to the long axis of the tubular. Each one of the fin modules includes a hub having an opening adapted to fit around the outer surface of the tubular, the hub including a stop structure configured to restrict the rotation of adjacent ones of the fin modules in the stack of fin module, and, one or more fin blades projecting from an outer surface of the hub. Rotating the tubular in one rotational direction aligns the fin modules into a screw-shaped state such that the one or more fin blades of adjacently stacked fin modules are progressively offset in a rotational direction perpendicular to the long axis of the tubular. Rotating the tubular in an opposite direction disperses the fin modules into a fanned-out state, such that the one or more fin blades of adjacently stacked fin modules are maximally offset as allowed by the stop structures.

20 Claims, 13 Drawing Sheets

(56) References Cited

U.S. PATENT DOCUMENTS

| | | | | |
|---|---|---|---|---|
| 2011/0030973 | A1 | 2/2011 | Jenner | |
| 2013/0319690 | A1 | 12/2013 | Levie et al. | |
| 2015/0027684 | A1* | 1/2015 | Jewett | E21B 47/13 166/60 |
| 2016/0251898 | A1* | 9/2016 | Angman | E21B 17/1078 175/57 |
| 2017/0204685 | A1* | 7/2017 | Gao | E21B 17/1028 |

OTHER PUBLICATIONS

"Moyno-General Utility Pumps"; http://www.moyno.com/products-we-offer/small-pumps/general-utility-pumps.html; 2016; 1 page.
"Small Pumps"; NOV; industrial@nov.com; nov.com/industrial; 2 pages.

* cited by examiner

FORMATION SCREW AND CENTRALIZER

CROSS-REFERENCE TO RELATED APPLICATION

This application claims the benefit of WO Application Serial No. PCT/US2018/055195, filed by Samuel J. Lewis, et al. on Oct. 10, 2018, entitled "FORMATION SCREW AND CENTRALIZER," commonly assigned with this application and incorporated herein by reference in its.

BACKGROUND

Subterranean wellbores to recover hydrocarbons often include well pipes (liners) positioned in the wellbore or in a wellbore casing. Since wellbores or wellbore casings are not generally perfectly vertical, centralizers are used to maintain the liners alignment to thereby potentially reduce the force required to convey the liners within the well and reduce any damage that may occur as the line moves within the wellbore. However, some centralizers may obstruct the flow path which can result in higher pumping pressures and/or the centralizer may have only a few points of contact (e.g., 4 or less contact points) which can deter from maintaining the liners alignment. Such centralizers can present difficulties when running a casing in the wellbore and in particular when running the casing in a curved or horizontal section of the wellbore.

Additionally, when drilling fluid is circulated in the annular space between the liner and the wellbore or the wellbore casing, the drilling fluid may assume a channeled flow within the annular space whereby only a portion of the fluid within the annular space is flowing relative to the liner and wellbore or wellbore casing while other portions of the drilling fluid (e.g., cutting chips) remain relatively static against the wellbore wall and thereby impede the liner's movement down the wellbore (e.g., due to differential sticking). Such channeling flow can also undesirably cause cement slurry to incompletely displace the drilling fluid from the annular space, resulting in an incomplete or inadequately mixed cement seal being formed.

BRIEF DESCRIPTION

Figure 1:
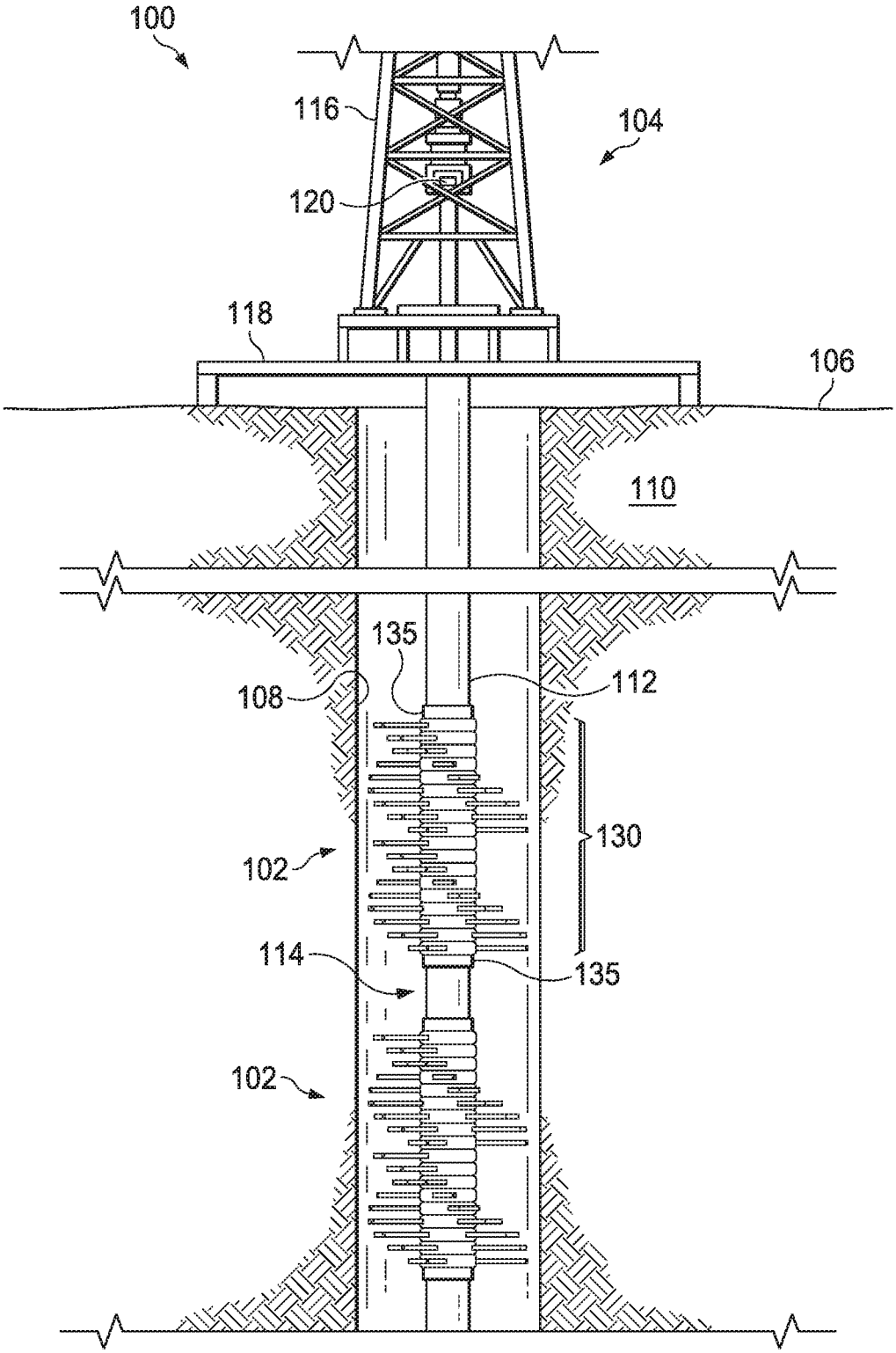
Figure 2:
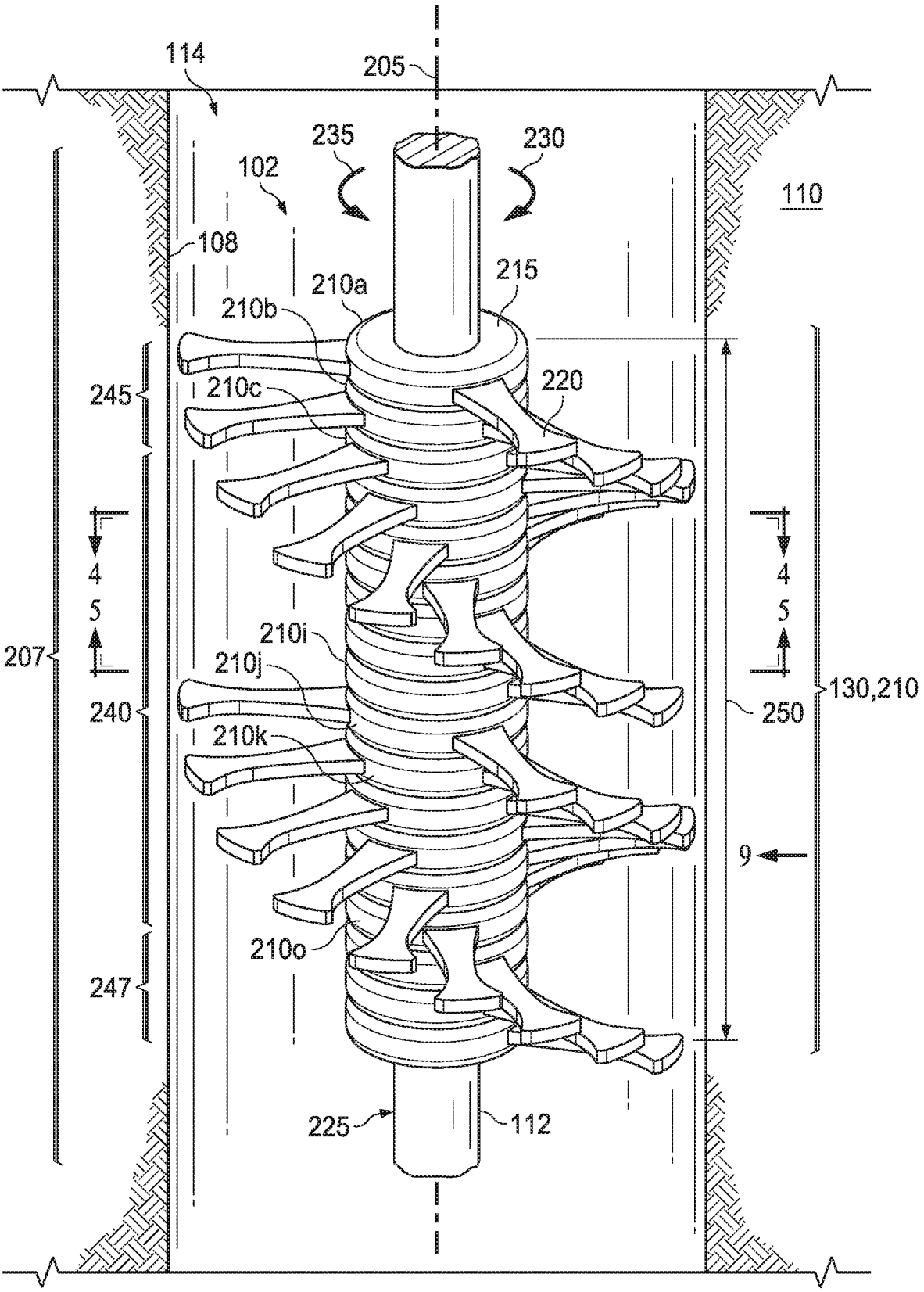
Figure 3:
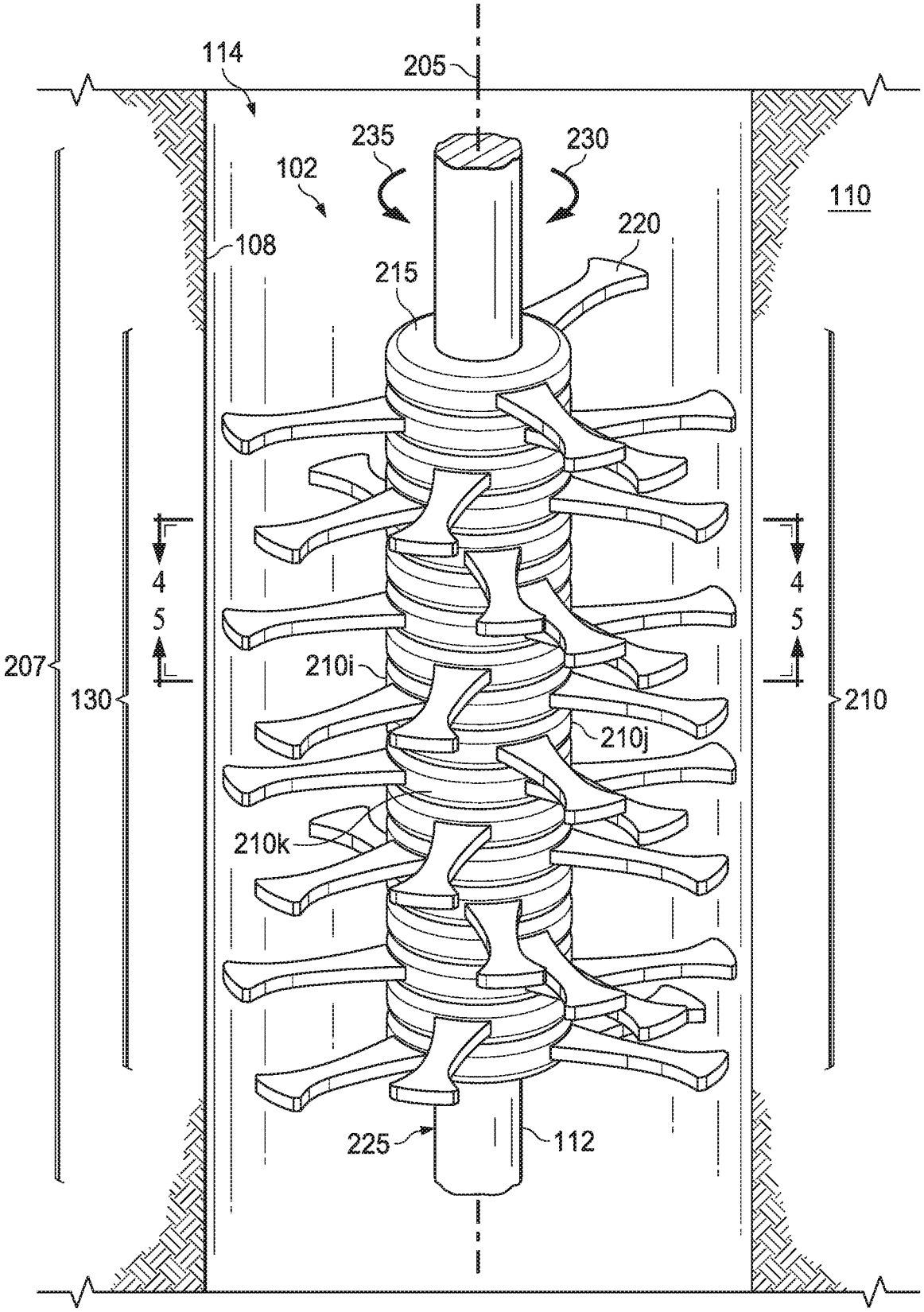
Figure 4:
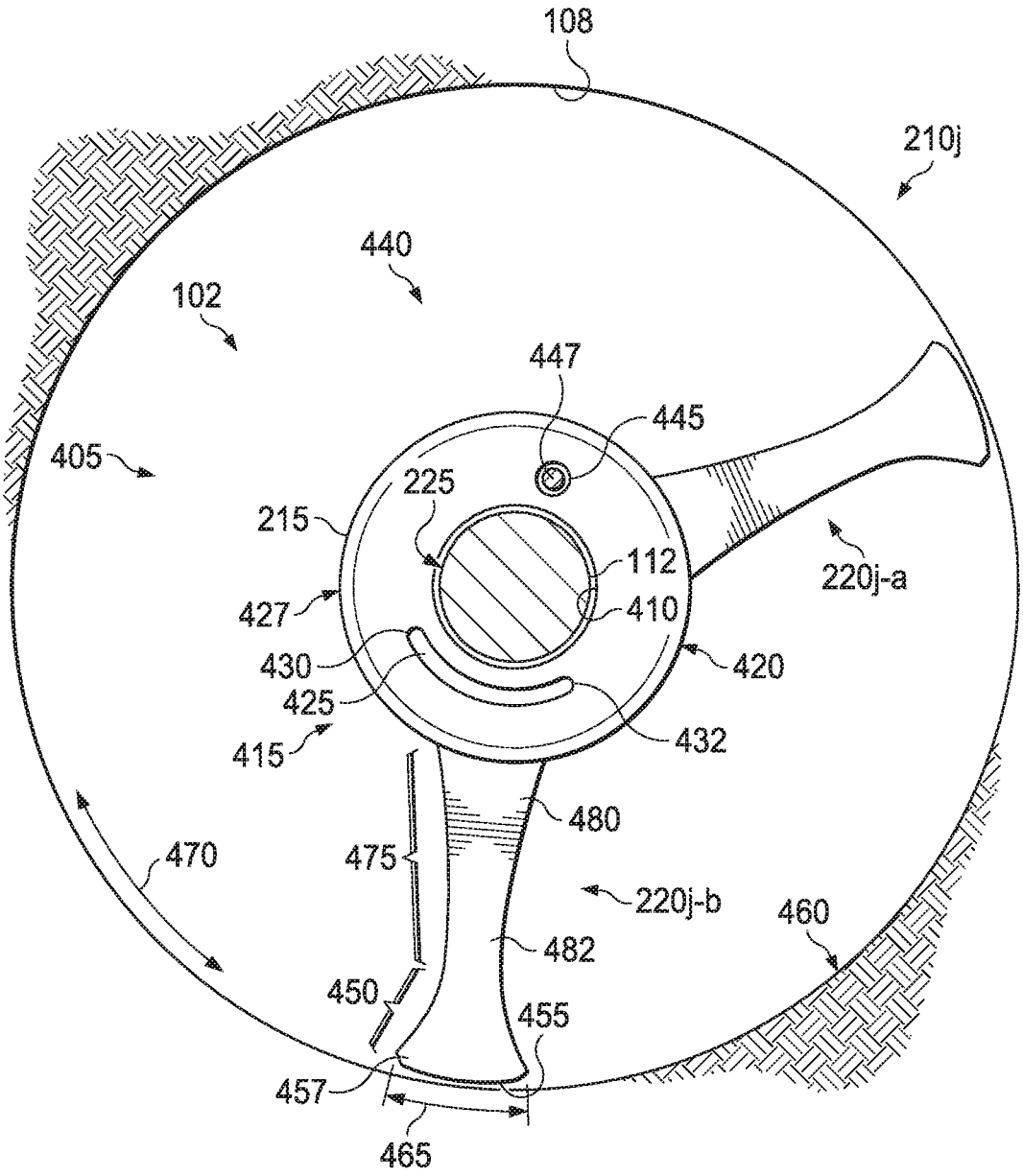
Figure 5:
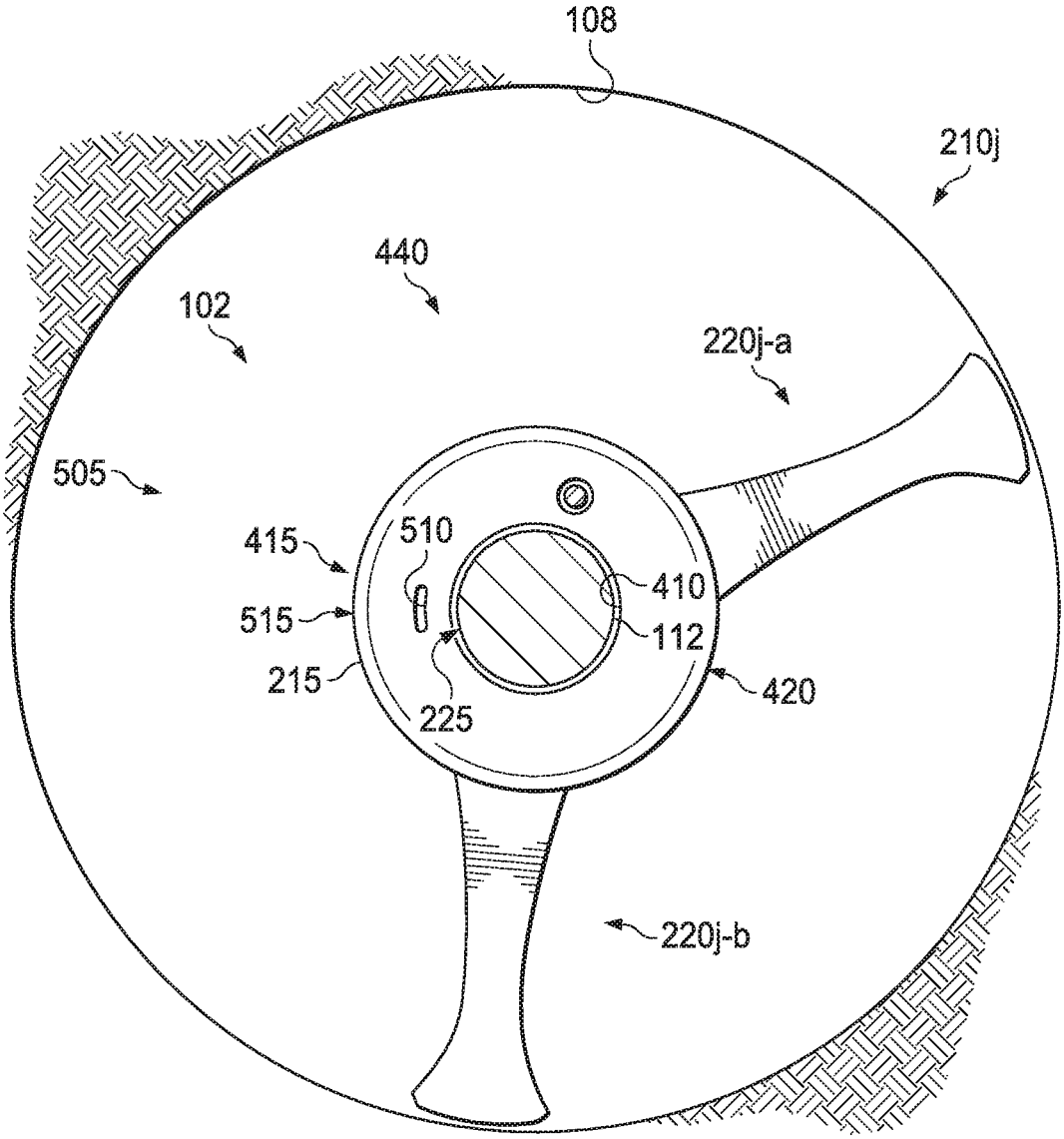
Figure 6:
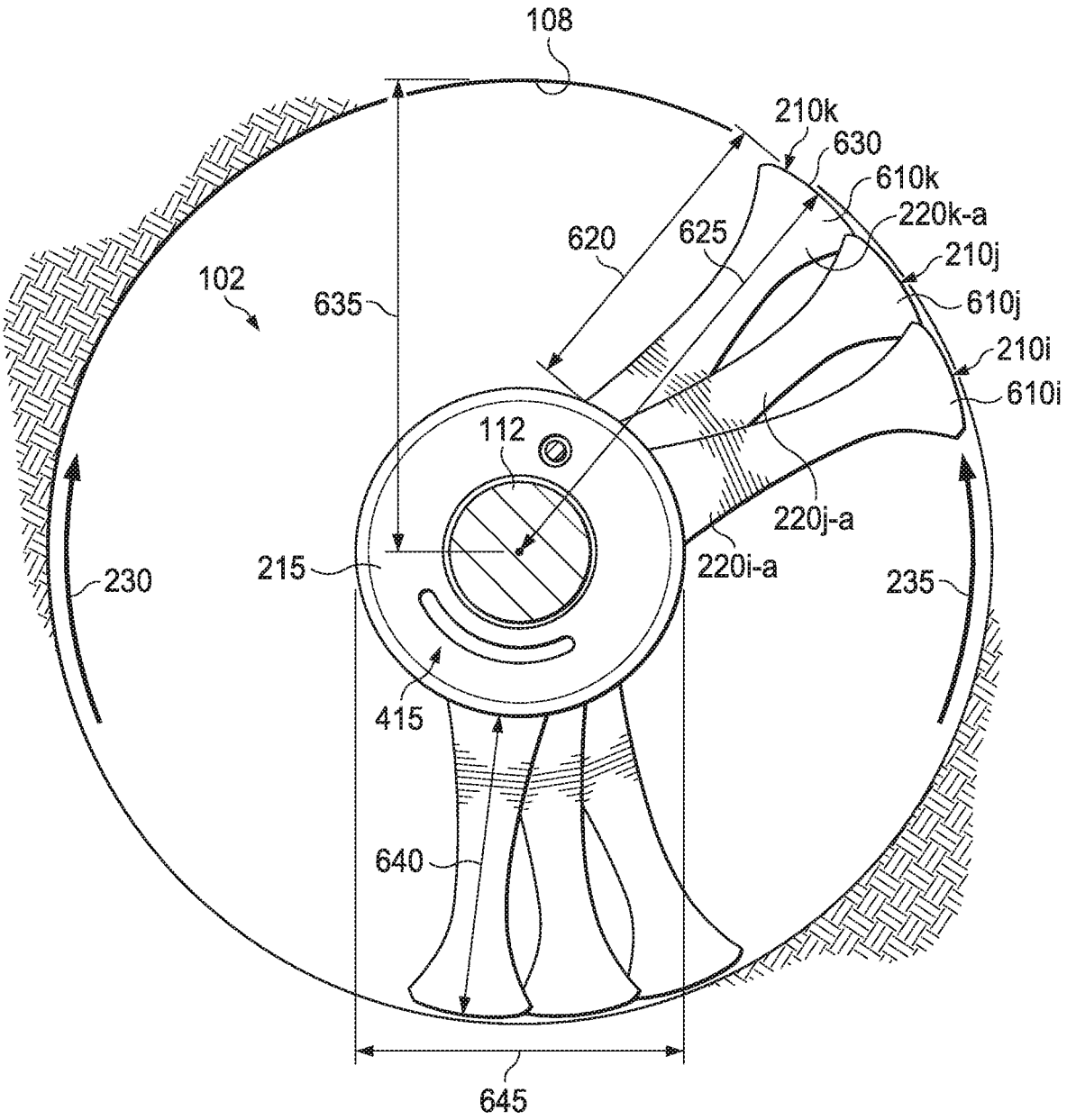
Figure 7:
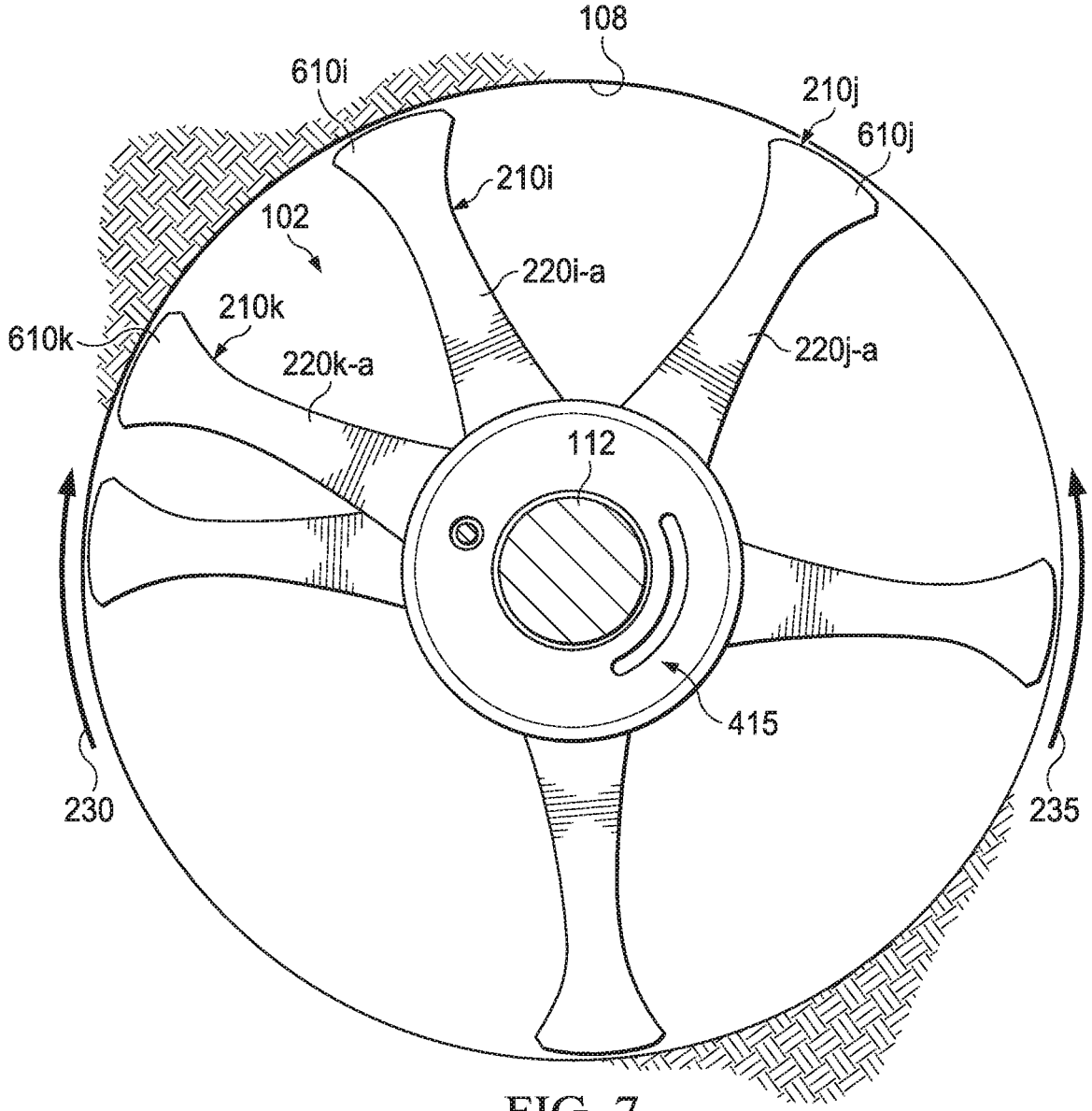
Figure 8:
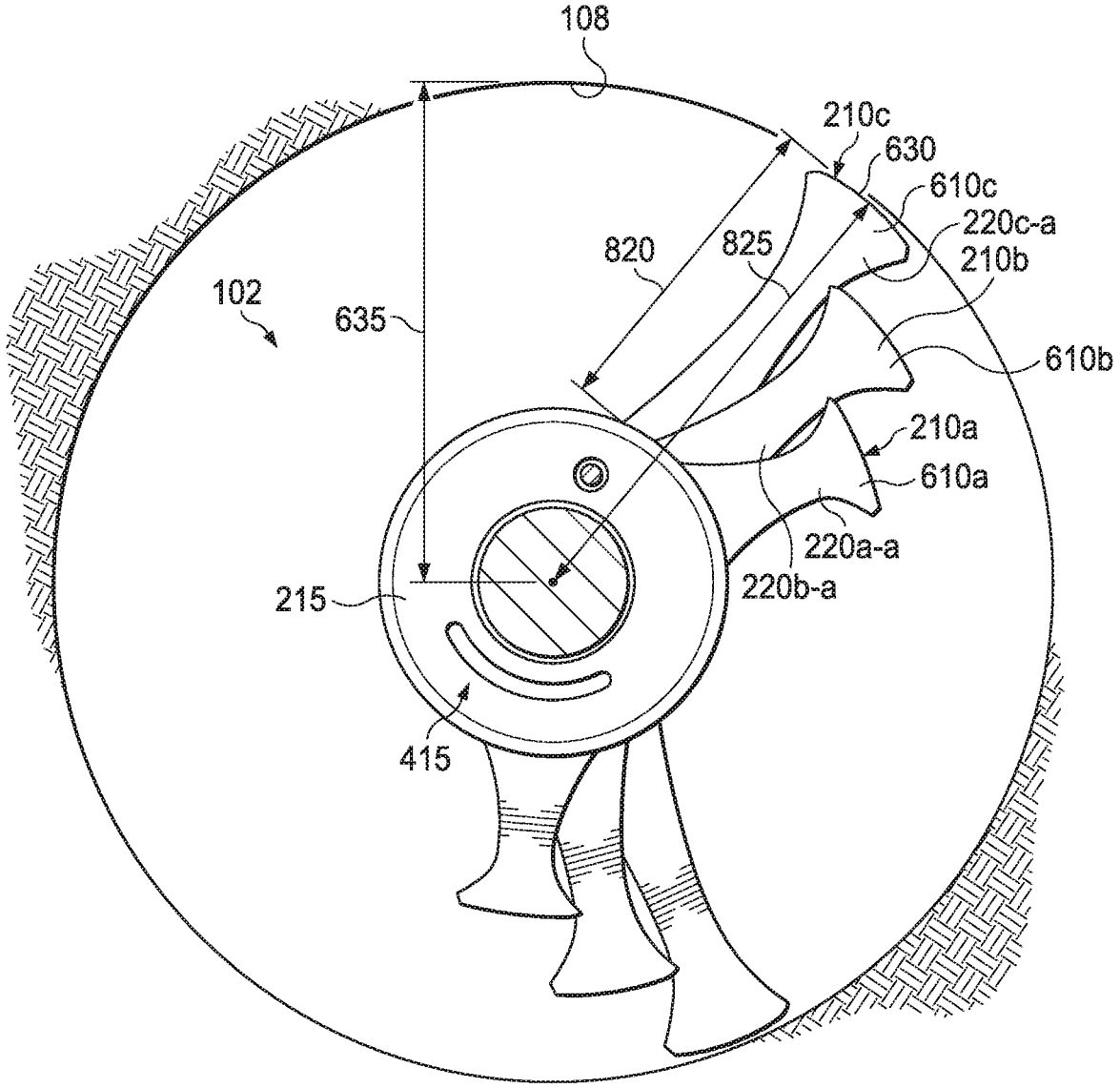
Figure 9A:
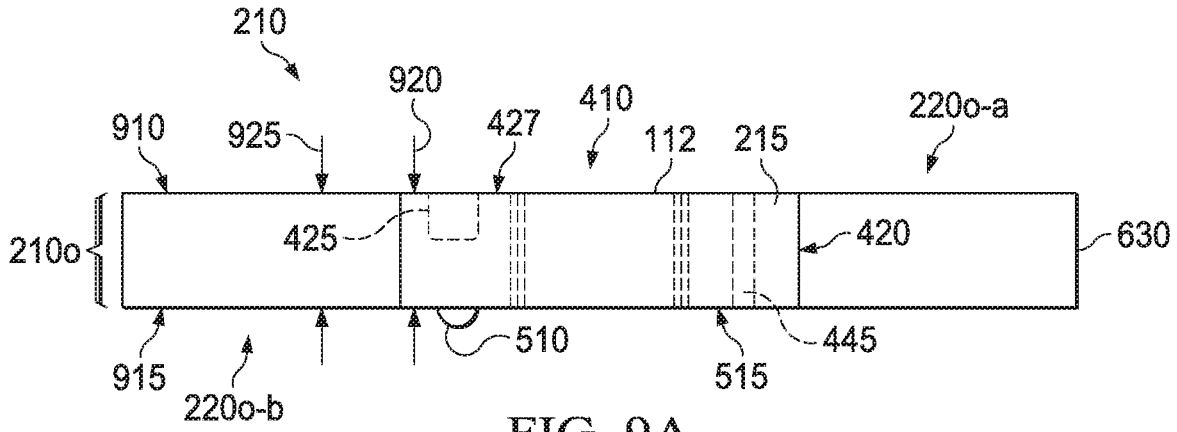
Figure 9B:
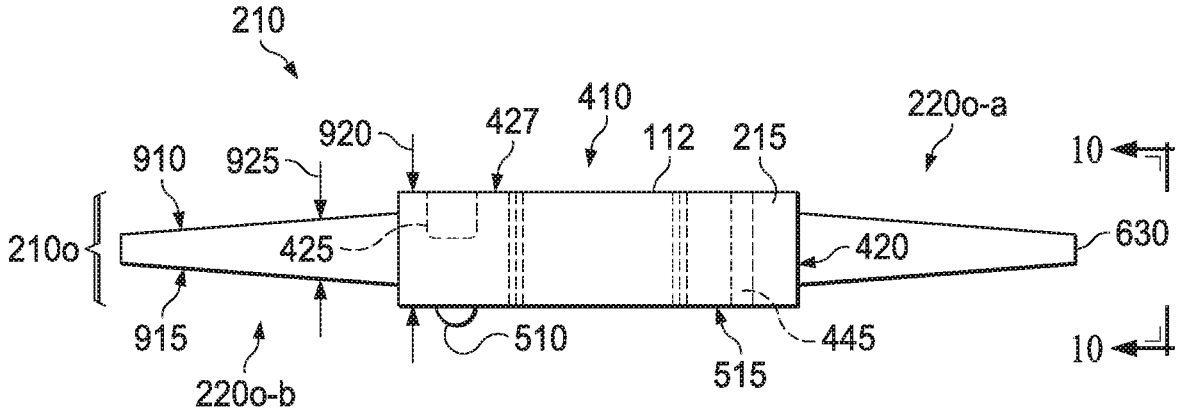
Figure 10A:
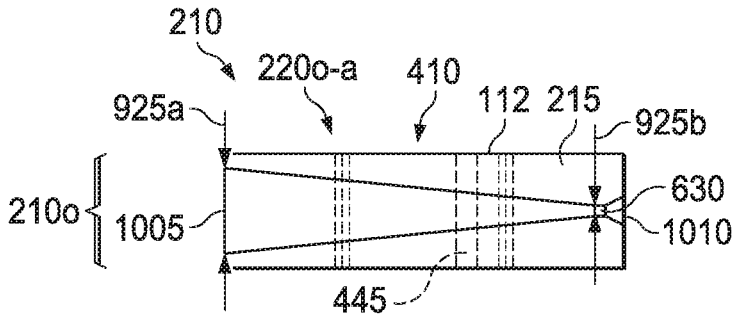
Figure 10B:
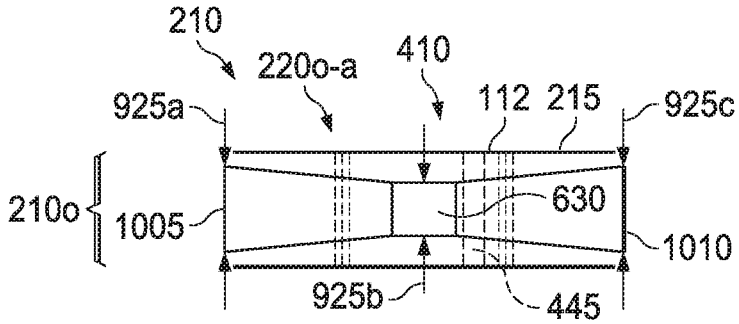
Figure 11:
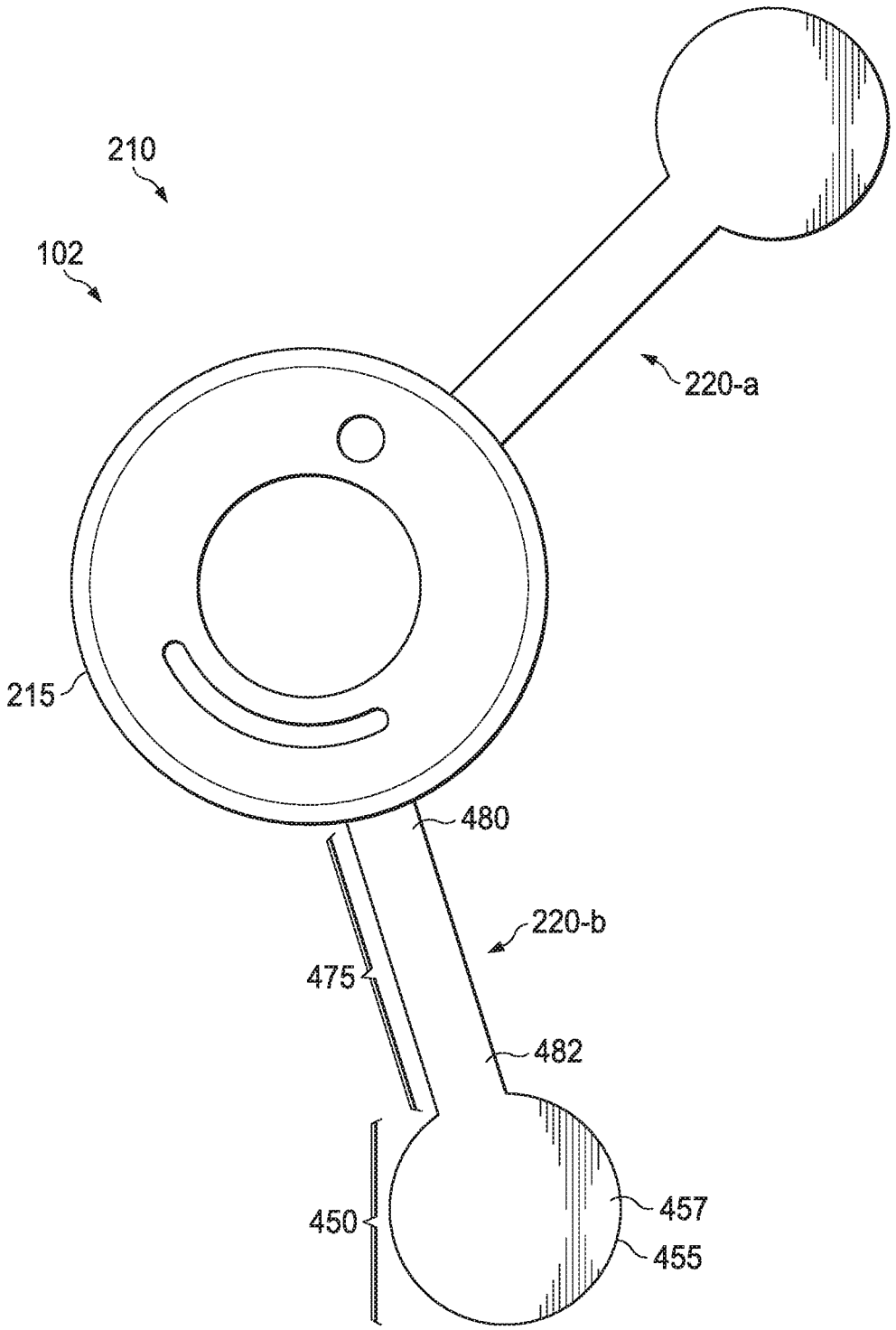
Figure 12A:
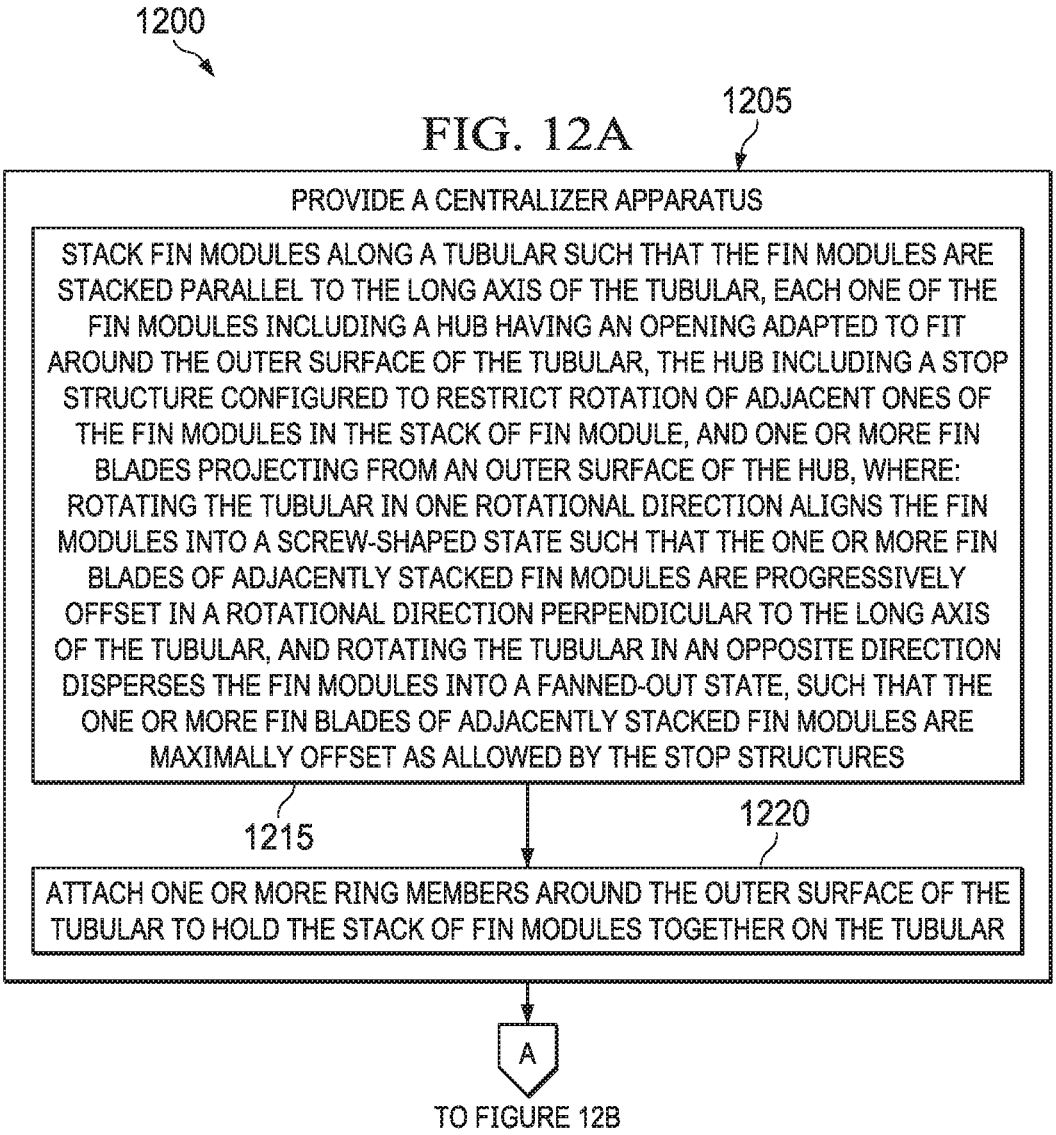
Figure 12B:
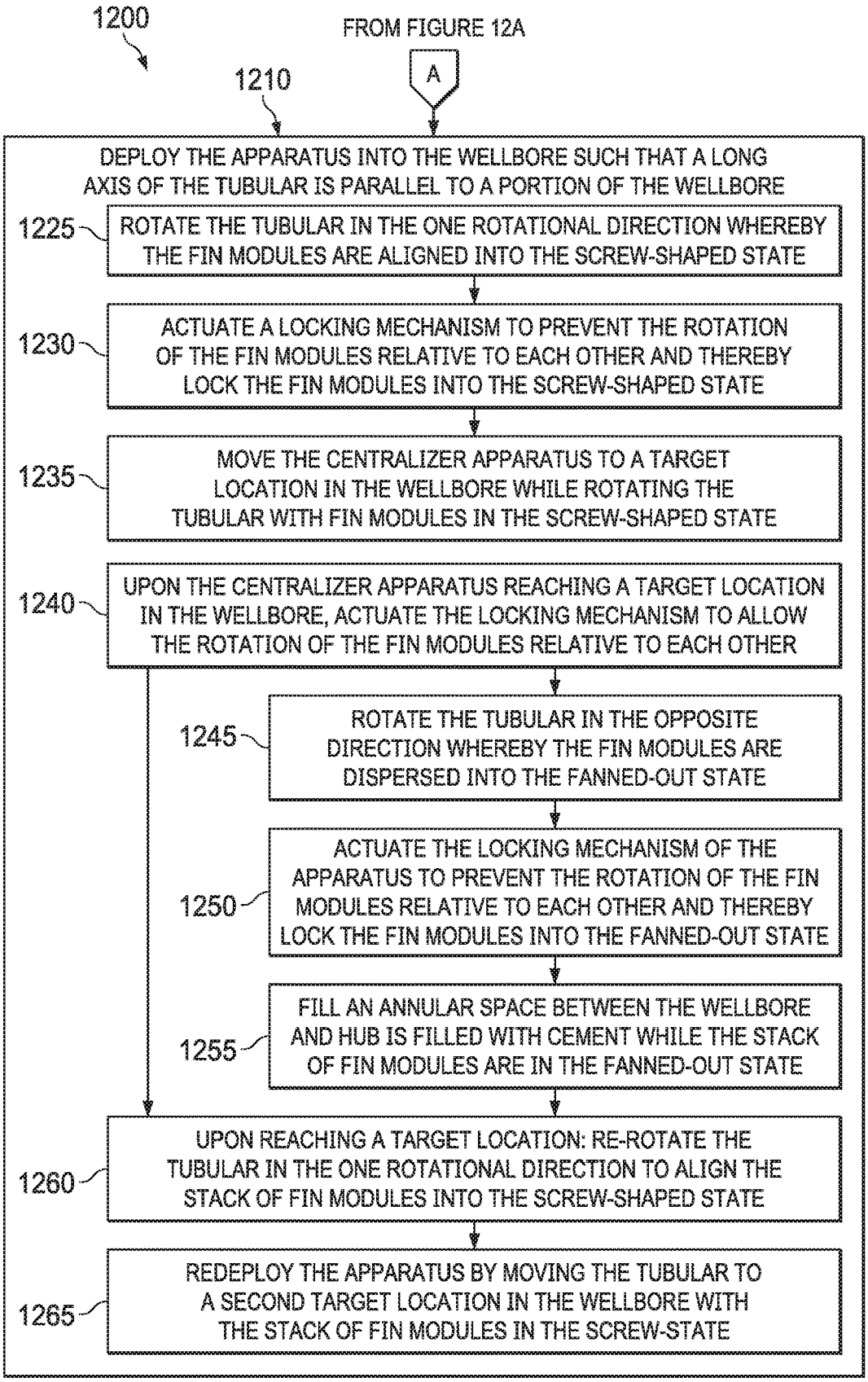

Reference is now made to the following descriptions taken in conjunction with the accompanying drawings, in which:

FIG. 1 illustrates a cut-away view of an embodiment of a well system configured to use an embodiment of the centralizer apparatus of the disclosure;

FIG. 2 presents a detailed perspective view of a centralizer apparatus similar to one of the centralizer apparatuses shown in FIG. 1 where the centralizer apparatus is in a screw-state;

FIG. 3 presents a detailed perspective view of the centralizer apparatuses shown in FIG. 2 where the centralizer apparatus is in a fanned-out-state;

FIG. 4 presents a first side plan view, along view direction 4-4 in FIG. 2, of one embodiment of a fin module of the centralizer apparatus such as any of the centralizer apparatuses shown in FIGS. 1-3;

FIG. 5 presents a second side plan view, along view direction 5-5 in FIG. 2, of the embodiment of the fin module shown in FIG. 4;

FIG. 6 presents a plan view of one embodiment of a central portion of a stack of fin modules of the centralizer apparatus, similar to the plan view shown in FIG. 4, when the centralizer apparatus is in a screw-state;

FIG. 7 presents a plan view of the stack of fin modules similar to that shown in FIG. 6 when the centralizer apparatus is in a fanned-out-state;

FIG. 8 presents a plan view of one embodiment of an end portion of a stack of fin modules of the centralizer apparatus, similar to the plan view shown in FIG. 6, when the centralizer apparatus is in a screw-state;

FIG. 9A presents a side view, along view direction 9-9 in FIG. 2, of one embodiment of a fin module of the centralizer apparatus;

FIG. 9B presents a side view, along view direction 9-9 in FIG. 2, of another embodiment of a fin module of the centralizer apparatus;

FIG. 10A presents a side view, along view direction 10-10 in FIG. 9B, of one embodiment of a fin module of the centralizer apparatus;

FIG. 10B presents a side view, along view direction 10-10 in FIG. 9B, of another embodiment of the fin module of the centralizer apparatus;

FIG. 11 presents a first side plan view, along view direction 4-4 in FIG. 2, of another embodiment of a fin module of the centralizer apparatus; and FIGS. 12A and 12B present a schematic flowchart of an illustrative embodiment of a method of deploying a centralizer apparatus of the disclosure in a subterranean wellbore, including any of the embodiments of the centralizer apparatus or well system discussed in the context of FIGS. 1-11.

DETAILED DESCRIPTION

As part of the present disclosure, we recognized that a plurality of discrete fin modules of a centralizer apparatus can be arranged in a stack such that fin blades of the modules form a discontinuous auger-shaped structure, e.g., a screw-state. When in such a screw-state, rotating the centralizer in one rotational direction creates a screwing action which can help draw a tubular (e.g., a liner or casing) into the wellbore formation, analogous to a drywall screw, and thereby reduce differential sticking. The swirling motion of the discontinuous auger-shaped structure's fin blades can facilitate a larger fluid flow path that also directs the fluid around the entire wellbore. This increased flow path results in more efficient pumping and thereby can facilitate the use more centralizers in the wellbore. Additionally, the screw-state can help to keep the tubular off the bottom of the wellbore while assisting the movement of the tubular or a casing into vertical or horizontal sections of the wellbore.

Further, reversing the rotational direction of the centralizer fans out the fin blades into multiple high surface area blades, e.g., a fanned-out-state, that can help support and centralize the tubular, and can facilitate the downhole mixing of cement. When in such a fanned-out state, the fin blades can facilitate cleaning by cementing pre-treatments, e.g., by forcing cleaning pills to swirl and scour the mud cake clear before the cement lands. Additionally, the fin blades in the fanned-out state can help to facilitate a last downhole mixing of the cement with improved displacement around the wellbore including the casing by forcing the fluids to swirl around the fanned-out fin blades. Also, the fanned-out state of the fin blades, by providing multiple radial reinforcement points, can help to reinforce the cement in the wellbore including the casing to mitigate against annular cracking.

One embodiment is a centralizer apparatus for deployment in a subterranean wellbore. FIG. 1 illustrates a cut-away view of an embodiment of a well system 100 configured to use an embodiment of the centralizer apparatus 102 of the disclosure. As depicted, the system 100 includes a drilling rig 104 that is positioned on the earth's surface 106 and extends over and around a wellbore 108 that penetrates a subterranean formation 110 for the purpose of recovering hydrocarbons. The wellbore 108 may be drilled into the subterranean formation 110 using any suitable drilling technique. The wellbore 108 extends substantially vertically away from the earth's surface 106 but can also include portions with orientations that deviate or transition from vertical relative to the earth's surface 106 to portions deviated at any suitable angle, including horizontal and/or curved portions. One or more of the centralizer apparatuses 102 can be located in any such vertical and/or deviated portions of the wellbore 108.

A wellbore tubular 112 including the centralizer apparatus 102 may be lowered into the subterranean formation 110 for a variety of workover or treatment procedures throughout the life of the wellbore. The embodiment shown in FIG. 1 illustrates the wellbore tubular 112 in the form of a liner being lowered into the subterranean formation. The wellbore tubular 112 and centralizer apparatus 102 are equally applicable to any type of wellbore tubular being inserted into a wellbore, including as non-limiting examples, drill pipe, production tubing, rod strings, and coiled tubing. The centralizer apparatus 102 may also be used to centralize various subs and workover tools. In the embodiment shown in FIG. 1, the wellbore tubular 112 may be conveyed into the subterranean formation 110 in any conventional manner and be secured within the wellbore 108 by filling an annulus 114 between the wellbore tubular 112 and the wellbore 108 with cement such as further discussed below. Embodiments of the wellbore 108 may be cased, partially cased or uncased.

The drilling rig 104 comprises a derrick 116 with a rig floor 118 through which the wellbore tubular 112 extends downward from the drilling rig 104 into the wellbore 108. The drilling rig 104 can include a motor driven winch 120 and other associated equipment for extending the wellbore tubular 112 into the wellbore 108 to position the wellbore tubular 112 at a selected depth. While the operating environment depicted in FIG. 1 refers to a stationary drilling rig 104 for lowering and setting the wellbore tubular 112 and the centralizer apparatus 102 within a land-based wellbore 108, in alternative embodiments, mobile workover rigs, wellbore servicing units (such as coiled tubing units), and the like may be used to lower the wellbore tubular 112 and the centralizer apparatus 102 into the wellbore 108, including an offshore wellbore operational environment.

As illustrated in FIG. 1, the apparatus 102 can include a stack 130 of fin modules. As further illustrated in FIG. 1, embodiments of the apparatus 102 can further include one or more ring members 132 (e.g., end fittings or central fittings) that facilitate holding the stack 130 of fin modules together and in a desired location on a tubular 112 and in some cases also act as a fitting to connect two tubulars 112 together.

In some embodiments, the tubular 112 can be a liner (e.g., a wellbore string liner pipe) and the ring members 132 can be conventional liner collars or other fitting adapted to hold the stack 130 of fin modules on the liner. In other embodiments, the tubular 112 can be part of a casing (e.g., a wellbore casing joint or setting pipe) and the ring members 132 can be a casing collar or other fitting adapted to hold the stack 130 of fin modules on the casing.

FIGS. 2 and 3 present detailed perspective views of an embodiment of the centralizer apparatus 102, similar to one shown in FIG. 1, where the stack 130 of fin modules of the apparatus 102 are in a screw-state and in a fanned-out-state, respectively.

With continuing references to FIGS. 1-3 throughout, embodiments of the apparatus 102 can include a tubular 112 (e.g., a central tubular) adapted to be deployed in the subterranean wellbore 108 such that a long axis 205 of the tubular 112 is parallel to a portion of the wellbore 108 (e.g., the long axis 205 parallel to a local portion 207 of the wellbore bore where the apparatus 102 is deployed for the local orientation of the tubular 112). The apparatus 102 includes a stack 130 of fin modules 210 stacked parallel to the long axis 205 of the tubular 112 in the wellbore 108. As illustrated for the apparatus embodiment shown in FIGS. 2-3, each one of the fin modules 210 includes a hub 215 and at least one fin blade 220.

FIG. 4 presents a first side 405 plan view (e.g., a top or bottom view), along view direction 4-4 in FIG. 3, of one of the fin modules (e.g., module 210*j* from the stack 130 of modules 210) of the apparatus 102, shown in the context of being deployed in the wellbore 108 and positioned around the tubular 112. FIG. 5 presents a second side 505 plan view (e.g., the other of the bottom or top view), along view direction 5-5 in FIG. 3, of the embodiment of the fin module 210*j* shown in FIG. 4.

As illustrated in FIGS. 2-5, the fin module 210*j* includes a hub 215 having an opening 410 adapted to fit around the outer surface 225 of the tubular 112. The hub 215 includes a stop structure 415 configured to restrict the rotation of adjacent ones of the fin modules (fin modules 210*i*, 210*k*, FIG. 2) in the stack of fin modules. The one or more fin blades (e.g., blades 220*j-a*, 220*j-b*) project from an outer surface 420 of the hub 215.

FIG. 6 presents a plan view of one embodiment of a central portion 240 of a stack of fin modules (e.g., including modules 220*i*, 220*j*, 220*k* from the stack 130 of modules 210) of the centralizer apparatus, similar to the plan view shown in FIG. 4, when the centralizer apparatus 102 is in a screw-state. FIG. 7 presents a plan view of the stack of the fin modules 220*i*, 220*j*, 220*k*, similar to that shown in FIG. 6, when the centralizer apparatus 102 is in a fanned-out-state. FIG. 8 presents a plan view of one embodiment of one of two end portions (e.g., portions 245, 247) of the stack of fin modules (e.g., including modules 220*a*, 220*b*, 220*c* from the stack of modules) of the centralizer apparatus 102, similar to the plan view shown in FIG. 6, when the centralizer apparatus 102 is in a screw-state.

As illustrated in FIGS. 2 and 6, rotating the tubular 112 in one rotational direction (e.g., one of clockwise direction 230 or opposite counter-clockwise direction 235) aligns the fin modules 210 into a screw-shaped state such that the one or more fin blades 220 of adjacently stacked fin modules (e.g., modules 220*i*, 220*j*, 220*k*) are progressively offset in a rotational direction perpendicular to the long axis of the tubular. That is, as the tubular 112 rotates in the one direction, the fin modules 210 continue to rotate in the one direction until stopped by the stop structure 415, at which point the adjacent fin modules 210 have a progressive offset corresponding to the screw-shaped state. The term, progressively offset means that in the rotational direction 230 or 235, ends of the adjacent ones of fin blades (e.g., ends 610*i*, 610*j*, 610*k* for fin blades 220*i-a*, 220*j-a*, and 200*k-a*, respectively) of adjacent fin modules 220*i*, 220*j*, 220*k* are nearest neighbors as compared to the ends of non-adjacent ones of the fin modules 210 (e.g., modules separated by two, three, four or more other modules).

As illustrated in FIGS. 3 and 7, rotating the tubular 112 in an opposite direction (e.g., the other one of the counter-clockwise direction 235 or clockwise direction 230) disperses the fin modules 210 into a fanned-out state, such that the one or more fin blades 220 of the adjacently stacked fin modules are maximally offset as allowed by the stop structure 415. That is, as the tubular 112 rotates in the other direction, the fin modules 210 continue to rotate in the other direction until stopped by the stop structure 415, at which point, the adjacent fin modules 210 have a maximally dispersed offset corresponding to the fanned-out state. The term, maximally offset, means that in the rotational direction 230, 235, ends of the adjacent ones of fin blades (e.g., ends 610*i*, 610*j*, 610*k* for fin blades 220*i-a*, 220*j-a*, and 200*k-a*, respectively) of adjacent fin modules 220*i*, 220*j*, 220*k* are farther separated from each other as compared to the ends of non-adjacent ones of the fin modules 210 (e.g., modules separated by two, three, four or more other modules).

FIGS. 4 and 5 also illustrate aspects of an example stop structure 415. The stop structure 415 can include at least one slot 425 on one side (e.g., one of sides 405 or 505) of the hub 215 and at least one raised feature 510 on the opposite side (e.g., the other of side 505 or 405) of the hub 215. The slot 425 (e.g., formed in the surface 427 of the one side 405 or the surface 515 of side 505) is configured to hold the raised feature 510 from (i.e., belonging to) one of the adjacent fin modules (e.g., one of modules 210*i* nor 210*k*) therein. The raised feature 510 is configured to be held in the slot of the other one of the adjacent fin modules (e.g., the other of modules 210*k* nor 210*i*). As illustrated, the slot 425 can be an arc-shaped or semi-circular opening in the hub 215 such that the raised feature 510 of the adjacent module 210 (e.g., a cylindrically or hemispherical shaped pin) can smoothly move within the slot 425 without touching the sides of the slot 425 as the modules rotate relative to each other until reaching one of the ends 430, 432 of the slot 425. In some embodiments, the slot 425 can pass all the way through the hub (i.e., a through-hole opening slot). The raised structure 510 protrudes above the surface 515 of the side 505 of the hub 215 that it is located on. Non-limiting example shapes of the raised structure 510 include arc-shaped segments, cylindrical pins or the semi-hemispherically shaped bumps. One skilled in the pertinent art would understand how the shape and dimensions of the slot 425 and the raised feature 510 (e.g., the length of the arc-shaped slot opening 425, the shape and size of the raised feature 510) could be adjusted to control the extent of rotational movement one fin module relative to its adjacent fin modules. For example in various embodiments, the slot 425 and raised feature 510 can be constructed such that adjacent ones of the fin modules can rotate by about 180, 137, 120, 90, 68, 45 or 30 degrees relative to each other. In some embodiments, there can be one or more slot 425 and raised feature 510 on a same side of the hub 215 or on both sides of the hub 215.

Embodiments of the apparatus 100 can further include a locking mechanism to prevent the rotation of the fin modules relative to each other. FIGS. 4 and 5 further illustrate aspects of an example locking mechanism 440. As illustrated, the locking mechanism can include an opening 445 (e.g., a through-hole opening) in the hub 215 of one or more of the fin modules, the opening 445 configured to hold a locking pin 447 therein. Such a locking mechanism 440 can be configured to lock the stack 130 of fin modules 210 into the screw-shaped state (e.g., FIG. 2) or into the fanned-out state (e.g., FIG. 3). In some embodiments, the apparatus 100 can include two separate locking mechanisms (e.g., two openings and two locking pins) each separately configured to lock the stack of fin modules 210 into one of these two states.

A wide variety of fin blade shapes could be used to improve flowability of fluids around the centralizer apparatus and/or improve the centralizer apparatus' centralizing action.

With continuing reference to FIG. 2, as illustrated in FIGS. 6 and 8, in some embodiments, to facilitate centralization of the tubular 112 when the apparatus is in the screw-state, a central portion (e.g., central portion 240, FIG. 2) of the stack of fin modules 210, wherein each of the one or more fin blades 220 (e.g., including blades 220*i-a*, 220*j-b*, 220*k-a*) have a substantially same length (e.g., length 620, FIG. 6) such that a distance 625 from the center of the hub to an outer edge 630 of the fin blade (e.g., blade 220*k-a*) is within a range from about 90 to 99 percent of a radius 635 of the wellbore 108 which the centralizer apparatus 102 is adapted to be deployed. And, to facilitate forming the screwing action when in the screw-state, in the end portions 245, 247 each of the fin blades of consecutive ones of the fin modules (e.g., blades 220*a-a*, 220*b-a*, 220*c-a*) have different lengths 820 such that a distance 825 from the center of the hub 215 to an outer edge 630 of the consecutive ones of the fin blades progressively increases in a range from about 40 to 90 percent of the radius 635 of the wellbore 108 from an outermost fin module (e.g., fin module 210*a*) of the end portions of the stack toward the central portion 240. That is, that is the fin blades of different one of the fin modules (e.g., from blades 220*a-a*, 220*b-a* 220*c-a* of modules 210*a*, 210*b*, 210*c*, respectively) in the end portions 245, 247 project progressively greater distances 620 as the modules come closer to the central portion 240 (e.g., towards fin modules 210*i*, 210*j*, 201*k*) to help define the screw-shapes state of the apparatus 102. As illustrated in FIG. 2, the stacked fin modules can be sufficient in numbers such that the progressively offset fin blades can make one or more complete circles around the circumference of the tubular 112.

The proportional lengths of the fin blades and numbers of fin modules in the central portion 240 and end portions 245, 247 can be selected to provide a balance between providing substantial lengths of progressively increasing length fins 220 to define an auger-type structure in the screw-state, e.g., to help to draw the centralizer apparatus and connected tubular 112 into the wellbore 108, versus having a substantial length of the central portion 240 that would provide same-length fins 220 to help provide centralizing support for the tubular 112. For instance, in some embodiments, the end portions 245, 247 of the stack of modules 210 correspond to about 10 to 50 percent of a total stack length (e.g., stack length 250, FIG. 2) and the central portion corresponds to the balance of the total stack length (e.g., 50 to 90 percent of stack length 250).

As illustrated in FIG. 6, in some embodiments the fin blades (e.g., fin blades of the central portion 240 of the stack 130 fin modules) a length 640 of the blade can be about equal to or greater than a diameter 645 of the hub 215. In other embodiments, such as when centralizing a tubular 112 and the annular space 114 between the wellbore 108 and the tubular is small and the tubular 112 occupies the bulk of the wellbore 108 (e.g., the tubular 112 is part of a wellbore casing), then much shorter blade lengths 640 can be advantageous. For instance, in some such embodiments, a ratio of the fin blade length 640 to hub diameter 645 can be in a range from about 0.05:1 to 0.5:1, or from about 0.1:1 to 0.2:1.

FIG. 9A presents a side view, along view direction 9-9 in FIG. 2, of one embodiment of a fin module (e.g., module 210*o*) of the centralizer apparatus 102, and, FIG. 9B presents a side view, along view direction 9-9 in FIG. 2, of another embodiment of the fin module.

As illustrated in FIGS. 9A and 9B, to facilitate compact stacking of fin modules 210 and/or to reduce flow resistance, the hub 215 and each of the one or more fin blades (e.g., blades 220*o-a*, 220*o-b*) can include a first planar surface (e.g., surfaces 427 and 910, respectively) and a second planer surface (e.g., surfaces 515 and 915, respectively), the first planer surface (e.g., one of surfaces 427 and 910 or surfaces 515 and 915) oriented towards the top of the wellbore (e.g., towards surface 106, FIG. 1) into which the centralizer is to be deployed, the second planer surface (e.g., the other of surfaces 427 and 910 or surfaces 515 and 915) oriented towards the bottom of the wellbore (e.g., away from surface 106, FIG. 1) into which the centralizer apparatus is to be deployed. For instance, with the exceptions of the slot 425, the opening 445 and the raised feature 510 a thickness 920 of the hub 215 is substantially equal to (e.g., within 90 percent) of a thickness 925 of the fin blades 220*o-a*, 220*o-b*.

As illustrated in FIG. 9A, in some embodiments, the surfaces of the fin blades 910, 915 can be co-planar with the respective surfaces of the hub 427, 515. Alternatively, as illustrated in FIG. 9B, in some embodiments one or more surfaces of the fin blades 910, 915 can be non-co-planar with the respective first and second surfaces of the hub 427, 515, e.g., such as when the fin blades 910, 915 project from a portion of the outer surface 420 of the hub 215. In some such embodiments, the thickness 925 of the blades can gradually decrease (e.g., gradually taper or stepwise decrease) as the blades extend away from the hub 215 to the outer edge of the blade 630 nearest the wellbore (e.g., wellbore108, FIG. 2).

FIG. 10A presents a side view, along view direction 10-10 in FIG. 9B, of one embodiment of a fin module (e.g., module 210*o*) of the centralizer apparatus 102. FIG. 10B presents a side view, along view direction 10-10 in FIG. 9B, of another embodiment of a fin module.

As illustrated in FIG. 10A, to facilitate reduced flow resistance when rotating, a thickness (e.g., thickness 925) of each of the one or more fin blades (e.g., blades 220*o-a*, 220*o-b*) can taper from a thickest (e.g., thickness 925*a*) edge 1005 trailing the one direction of rotation (e.g., direction 230 or 235) to a narrowest edge 1010 at the blade's outer edge 630 (e.g., thickness 925*b*) leading the one direction of rotation. As illustrated in FIG. 10B, to facilitate reduced flow resistance when rotating in either rotational directions (e.g., directions 230 and 235), both edges of the blade 1005, 1010 can taper from a greatest thicknesses (e.g., thicknesses 925*a*, 925*c*) to a smallest thickness of the blade in a central portion of the blade's outer edge 630 (e.g., thickness 925*b*).

Returning to FIG. 4, as illustrated, in some embodiments, the one or more fin blades can have a shape profile (e.g., a profile in one or both of plan views 405, 505 shown in FIGS. 4 and 5, respectively) such that an end region (e.g., end region 450) of each of the fin blades 220 farthest away from the hub 215 have an isosceles trapezium shape with a convex curved end 455 located farthest away from the hub 215, e.g., so as to increase surface contact with the wellbore 108 when centralizing the tubular 112. In some such embodiments, a central plane (e.g., plane 457) of the isosceles trapezium shaped end region 450 is substantially perpendicular to a long axis of the tubular (e.g., axis 205 of tubular 112, FIG. 2). As further illustrated, in some such embodiments, the curved outer end 455 has a convex curvature which mirrors a concave curvature of an inner surface 460 of the wellbore 108 into which the centralizer apparatus 102 is to be deployed, e.g., to maximize the contact area with the wellbore surface 460 as part of centralizing the tubular 112. For example, in some embodiments, an arc length 465 of the convex-shaped end 455 of each of the fin blades 220 is in a range from about 1 to 10 percent of the inner circumference 470 of the inner surface 460 of the wellbore 108.

Based on the present disclosure, one skilled in the pertinent art would understand how other fin blade shapes could be used within the scope of the disclosure.

For instance, as non-limiting example, FIG. 11 presents a first side plan view, along view direction 4-4 in FIG. 2, of another embodiment of a fin module 210 of the centralizer apparatus 102. As illustrated, the end region 450 of each of the fin blades 220-*a*, 220-*b* farthest away from the hub 215 is disc-shaped. A central plane 457 of the disc-shaped end region 450 can be substantially perpendicular to the long axis 205 of the tubular 112. A portion of the curved end 455 of the disc-shaped end region can mirror the concave curvature of the inner surface of the wellbore, similar to that described for the embodiment shown in FIG. 4.

For instance, as illustrated in FIG. 4, in some embodiments, a stem region 475 of each of the fin blades 220 projecting from the hub 215 has a substantially isosceles trapezoid shape where a base side 480 of the stem region 475 nearest the hub 215 is longer than a base side 482 of the stem region 475 nearest the end region 450 of the fin blade 220. Such a shape profile can provide greater mechanical strength near to the hub 215, e.g., to prevent distortion or breakage of the fin blades 220 when the centralizer apparatus 102 is being rotated in the wellbore 108 in the presence of drilling fluid or cement.

For instance, as illustrated in FIG. 11, in some embodiments, the stem region 475 of each of the fin blades 220 projecting from the hub 215 can have a substantially rectangular shape where a base side 480 of the stem region 475 nearest the hub 215 is the same length as a base side 482 of the stem region 475 nearest the end region 450 of the fin blade 220. Such a shape profile can provide lighter fin modules 210 which in turn requires less energy to rotate the stack 130 of fin modules 210.

In some embodiments, the apparatus 102 can further include the one or more ring members 132 adapted to fit around the outer surface 225 of the tubular 112 and to hold the stack 130 of fin modules 210 together on the tubular 112. In some embodiments, the stack 130 of fin modules can be pre-installed (e.g., off-site) around the tubular 112 and then held in place on the tubular 112 via the ring members 132. On-site, the tubular 112 with stack 130 can be connected to other tubulars 112 via the ring members 132. In other embodiments, the stack 130 of fin modules can be assembled on a tubular 112 on-site and then held in place with ring members 132 that are, or part of, conventional pipe fittings.

One skilled in the pertinent arts would be familiar we conventional manufacturing processes (e.g., machining, stamping, welding, casting, molding etc . . . ) to manufacture any of the embodiments of fin modules described herein.

Another embodiment is a method of deploying a centralizer apparatus in a subterranean wellbore. With continuing reference to FIGS. 1-11 throughout, FIGS. 12A and 12B present a schematic flowchart of an illustrative embodiment of a method 1200 of deploying a centralizer apparatus 102 in a wellbore 108.

As illustrated FIGS. 12A and 12B, the method 1200 can include providing a centralizer apparatus 102 (e.g., step 1205) and deploying the centralizer apparatus into the wellbore 108 such that a long axis 205 of a tubular 112 is parallel to a portion of the wellbore 108 (e.g., step 1210).

The method 1200 can be applied using any of the embodiments of the centralizer apparatus 102 or well systems 100 discussed in the context of FIGS. 1-11. Providing the apparatus (step 1205) can include stacking (step 1215) fin modules 210 along a tubular 112 such that a stack 130 of the fin modules 210 are stacked parallel to a long axis 205 of the tubular. Each one of the fin modules 210 can include a hub 215 and one or more fin blades 220 projecting from an outer surface 420 of the hub 215. The hub 215 can have an opening 410 adapted to fit around the outer surface 225 of the tubular 112, and include a stop structure 415 configured to restrict rotation of adjacent ones of the fin modules 210 in the stack 130. Rotating the tubular 112 in one rotational direction (230 or 235) can align the fin modules 210 into a screw-shaped state such that the one or more fin blades 220 of adjacently stacked fin modules 210 are progressively offset in a rotational direction perpendicular to the long axis 205 of the tubular 112. Rotating the tubular in an opposite direction (235 or 230) disperses the fin modules 220 into a fanned-out state, such that the one or more fin blades 210 of adjacently stacked fin modules 210 are maximally offset as allowed by the stop structures 415.

In some embodiments of the method 1200, providing the apparatus (step 1205) can further include attaching one or more ring members 132 around the outer surface of the tubular 225 to hold the stack 130 of fin modules together on the tubular 112 (step 1220).

As discussed in the context of FIGS. 1-11, embodiments of the centralizer apparatus 102 reversibly convertible and lockable between screw-shaped and fanned-out states of fin blades to allow for increased flow by serving an auger and providing a centralizer function and when converted to a fanned-out state to further serve the centralizer function and promote mixing of down-hole fluids including cement.

In some embodiments, deploying the apparatus 102 (step 1210) can include rotating the tubular 112 in the one rotational direction whereby the stack 130 of fin modules 210 are aligned into the screw-shaped state (step 1225). Deploying the apparatus 102 can further include actuating a locking mechanism 440 of the apparatus (e.g., inserting the locking pin 447 into the opening 445) to prevent the rotation of the fin modules 220 relative to each other and thereby lock the stack 130 of the fin modules 220 into the screw-shaped state (step 1230). Deploying the apparatus 102 can further include moving the apparatus 102 to a target location in the wellbore 108 while rotating the tubular 112 with the stack of the fin modules 210 in the screw-shaped state (step 1235). Deploying the apparatus 102 can further include, e.g., upon reaching the target location, actuating the locking mechanism 440 (e.g., removing the locking pin 447 from the opening 445) to allow the rotation of the fin modules relative to each other (step 1240).

In some embodiments, deploying the apparatus 102 (step 1210) can include, e.g. upon reaching a target location in the wellbore 108, rotating the tubular 112 in the opposite direction whereby the fin modules are dispersed into the fanned-out state (step 1245). Some such embodiments can further include actuating the locking mechanism 440 to prevent the rotation of the fin modules 220 relative to each other and thereby lock stack of the fin modules 220 into the fanned-out state (step 1250). Some such embodiments can further include filling an annular space between the wellbore and hub is filled with cement while the stack the fin modules are in the fanned-out state (step 1255).

Alternatively or additionally, deploying the apparatus 102 (step 1210) can include, upon reaching a target location, actuating the locking mechanism to allow the rotation of the fin modules relative to each other (e.g., repeat step 1240), re-rotating the tubular in the one rotational direction to align the fin modules into the screw-shaped state (step 1260), re-actuating the locking mechanism to lock the stack of the fin modules into the screw-shaped state (repeat step 1230) and redeploying the apparatus 102 by moving the tubular 112 to a second different target location (e.g., either above or below the first target location) in the wellbore 108 while rotating the tubular in the one rotational direction and with the stack of fin modules in the screw-state (step 1265).

Those skilled in the art to which this application relates will appreciate that other and further additions, deletions, substitutions and modifications may be made to the described embodiments.

What is claimed is:

1. A centralizer apparatus for deployment in a subterranean wellbore, comprising:

a tubular adapted to be deployed in the subterranean wellbore such that a long axis of the tubular is parallel to a portion of the wellbore; and a stack of fin modules stacked along to the long axis of the tubular, wherein each one of the fin modules includes:

a hub having an opening adapted to fit around the outer surface of the tubular, the hub including a stop structure configured to restrict the rotation of adjacent ones of the fin modules in the stack of fin module, and one or more fin blades projecting from an outer surface of the hub, wherein:

rotating the tubular in one rotational direction aligns the fin modules into a screw-shaped state such that the one or more fin blades of adjacently stacked fin modules are progressively offset in a rotational direction perpendicular to the long axis of the tubular, and rotating the tubular in the other rotational direction disperses the fin modules into a fanned-out state, such that the one or more fin blades of adjacently stacked fin modules are maximally offset as allowed by the stop structures.

2. The apparatus of claim 1, wherein the stop structure includes a slot on one side of the hub and a raised feature on the opposite side of the hub, the slot configured to hold the raised feature from one of the adjacent fin modules therein and raised feature configured to be held in the slot of the other one of the adjacent fin modules.

3. The apparatus of claim 1, further including a locking mechanism to prevent the rotation of the fin modules relative to each other, the locking mechanism including an opening in the hub of one or more of the fin modules, the opening configured to hold a locking pin therein.

4. The apparatus of claim 3, where in the locking mechanism is configured to lock the stack of fin modules into the screw-shaped state or into the fanned-out state.

5. The apparatus of claim 1, wherein:

a central portion of the stack of fin modules, wherein each one or more of the fin blades have a same length such that a distance from the center of the hub to an outer edge of the fin blade is within a range of about 90 to 99 percent of a radius of the wellbore which the centralizer apparatus is adapted to be deployed, and end portions of the stack of fin modules each of the fin blades have different lengths such that a distance from the center of the hub to an outer edge of the fin blade progressively increases in a range from about 40 to 90 percent of the radius of the wellbore from the outermost fin module of the end portions of stack toward the central portion of the stack.

6. The apparatus of claim 1, wherein the hub and each of the fin blades include a first planar surface and second planar surface, the first planar surface oriented towards a top of the wellbore into which the centralizer is to be deployed, the second planer surface oriented towards a bottom of the wellbore into which the centralizer is to be deployed.

7. The apparatus of claim 1, wherein a thickness of each of the fin blades tapers from a thickest edge trailing the one direction of rotation to a narrowest edge leading the one direction of rotation.

8. The apparatus of claim 1, wherein an end region of each of the fin blades farthest away from the hub is isosceles trapezium shaped with a convex curved end located farthest away from the hub, wherein a central plane of the isosceles trapezium shaped end is perpendicular to a long axis of the tubular.

9. The apparatus of claim 8, wherein the curved outer edge has a convex curvature which mirrors a concave curvature of an inner surface of the wellbore into which the centralizer apparatus is to be deployed.

10. The apparatus of claim 9, wherein an arc length of the convex-shaped end of each of the fin blades is in a range from about 1 to 10 percent of the inner circumference of the wellbore into which the centralizer is to be deployed.

11. The apparatus of claim 1, wherein an end region of each of the fin blades farthest away from the hub is disc-shaped, wherein a central plane of the disc-shaped end is perpendicular to a long axis of the tubular.

12. The apparatus of claim 1, wherein a stem region of each of the fin blades projecting from the hub has a isosceles trapezoid shape where a base side of the stem region nearest the hub is longer than a base side of the stem nearest an end region of the fin blade.

13. The apparatus of claim 1, further including one or more ring members adapted to fit around the outer surface of the tubular to hold the stack of fin modules together on the tubular.

14. The apparatus of claim 1, wherein the tubular is part of a wellbore liner or casing.

15. A method of deploying a centralizer apparatus in a subterranean wellbore, comprising:

providing the centralizer apparatus, including:

stacking fin modules along a tubular such that a stack of the fin modules are stacked along a long axis of the tubular, wherein each one of the fin modules includes:

a hub having an opening adapted to fit around the outer surface of the tubular, the hub including a stop structure configured to restrict rotation of adjacent ones of the fin modules in the stack of fin modules, and one or more fin blades projecting from an outer surface of the hub, wherein:

rotating the tubular in one rotational direction aligns the fin modules into a screw-shaped state such that the one or more fin blades of adjacently stacked fin modules are progressively offset in a rotational direction perpendicular to the long axis of the tubular, and rotating the tubular in the other rotational an opposite direction disperses the fin modules into a fanned-out state, such that the one or more fin blades of adjacently stacked fin modules are maximally offset as allowed by the stop structures; and deploying the centralizer apparatus into the wellbore such that a long axis of the tubular is parallel to a portion wellbore.

16. The method of claim 15, wherein deploying the centralizer apparatus includes rotating the tubular in the one rotational direction whereby the stack of the fin modules are aligned into the screw-shaped state.

17. The method of claim 15, wherein deploying the centralizer apparatus includes, upon the centralizer apparatus reaching a target location in the wellbore, rotating the tubular in the opposite direction whereby the stack of the fin modules are dispersed into the fanned-out state.

18. The method of claim 17, actuating a locking mechanism of the apparatus to prevent the rotation of the stack of the fin modules relative to each other and thereby lock the fin modules into the fanned-out state.

19. The method of claim 18, filling an annular space between the wellbore and hub with cement while the stack the fin modules are in the fanned-out state.

20. The method of claim 15, wherein deploying the centralizer apparatus includes after reaching the target location:

actuating the locking mechanism to allow the rotation of the fin modules relative to each other, rotating the tubular in the one rotational direction to align the fin modules into the screw-shaped state, actuating the locking mechanism to prevent the rotation of the stack of the fin modules relative to each other and thereby lock the fin modules into the screw-state, and, moving the tubular to a second different target location in the wellbore while rotating the tubular in the one rotational direction and with the stack of the fin modules in the screw-state.

* * * * *